United States Patent [19]

Kitao et al.

[11] Patent Number: 4,606,006

[45] Date of Patent: Aug. 12, 1986

[54] METHOD OF CONTROLLING THE ROLLING EFFICIENCY IN HOT ROLLING

[75] Inventors: Nariharu Kitao; Masayasu Fukui, both of Okayama; Yoshiharu Hamasaki; Masaki Kutsuzawa, both of Hyogo, all of Japan

[73] Assignees: Mitsubishi Denki K.K., Tokyo; Kawasaki Steel Corp, Hyogo, both of Japan

[21] Appl. No.: 431,533

[22] Filed: Sep. 30, 1982

[30] Foreign Application Priority Data

Oct. 5, 1981 [JP] Japan ..... 56-158430

[51] Int. Cl.[4] ..... G06F 15/46; B21B 37/00; F27D 3/00; G06G 7/64

[52] U.S. Cl. ..... 364/472; 72/7; 72/8; 72/11; 432/11; 432/18; 266/80

[58] Field of Search ..... 432/11, 18, 45, 49, 432/51; 72/7, 8, 11, 202; 364/472, 478, 479, 477; 266/80, 90; 148/120

[56] References Cited

U.S. PATENT DOCUMENTS 3,695,594 10/1972 Hollander ..... 432/11
4,004,138 1/1977 Morooka et al. ..... 266/80 X
4,037,087 7/1972 Foulds ..... 72/8 X
4,223,385 9/1980 Miller et al. ..... 364/472
4,338,077 7/1982 Shibayama et al. ..... 432/11
4,373,364 2/1983 Tanimoto et al. ..... 432/11 X
4,501,522 2/1985 Wakamiya ..... 364/477 X

FOREIGN PATENT DOCUMENTS 55-84215 6/1980 Japan ..... 72/8

*Primary Examiner*—Jerry Smith
*Assistant Examiner*—Jon D. Grossman
*Attorney, Agent, or Firm*—Sughrue, Mion, Zinn Macpeak & Seas

[57] ABSTRACT

A method of controlling the rolling efficiency in a continuous hot rolling process. A rolling schedule and a conveying schedule are determined on a mill line for the slabs arranged in succession based on an aimed extraction temperature of the slabs from a heating furnace and a predetermined temperature at the exit of a finish mill. A minimum extraction pitch is calculated for the slabs from the heating furnace under restriction of the side of the mill line, and a different minimum extraction pitch is calculated for slabs from the heating furnace under restriction of the side of the heating furnace based on slab temperature charged to the heating furnace and the aimed extraction temperature. An optimum extraction pitch is determined for slabs from the heating furnace by comparing both of the minimum extraction pitches. With such a method, the continuous hot rolling operation is carried out under an optimum condition.

1 Claim, 5 Drawing Figures

METHOD OF CONTROLLING THE ROLLING EFFICIENCY IN HOT ROLLING

BACKGROUND OF THE INVENTION

This invention relates to a control method of a continuous hot rolling mill and particularly to a control method in which an extraction pitch of slabs from a heating furnace is set such that the total weight of slabs to be rolled per unit time can be maximized and stable rolling operation can be attained. In the continuous hot rolling process, the total weight of slabs to be rolled per unit time (hereinafter referred to as the rolling efficiency TPH (Ton Per Hour)) is determined in accordance with the entire production plan and it is desired to increase the rolling efficiency in order to improve the productivity of steel as much as possible.

However, the rolling efficiency has been dependent almost completely upon the operator's skill and the optimum use of the performance of the rolling facility as a whole.

SUMMARY OF THE INVENTION

This invention has been made in view of the foregoing state of art and it is an object to provide a control method for maximizing the rolling efficiency of a hot strip mill.

DETAILED DESCRIPTION OF PREFERRED EMBODIMENTS

Usually, in hot rolling, since the lower limit for the heating furnace extraction temperature $T_{EXTL}$* has a significant effect on the mechanical properties of the products in view of the mill operation, a finish mill exit temperature FDT is previously determined in order to maintain a desired value. Accordingly, a so-called rolling schedule including such variables as rolling speed $V_R$, conveying speed $V_T$, an adjusting speed $\alpha$ and a rolling pattern Hi for each of the facilities on the mill line for rolling products to a desired level while setting the aimed extraction temperature from the heating furnace at $T_{EXTL}$* and maintaining the temperature at the exit of the finish mill at a predetermined value FDT can be determined based on information such as thickness, length, width and types of individual slabs, as well as thickness, width and the like of desired products (see "Rolling Theory and Its Application", edited by Japan Iron and Steel Associates and published from Seibundo Shinkosha).

Once the rolling schedule is determined for each of the slabs, the manner of the movement for the slab on the mill line during the extraction from the heating furnace, the rolling and the winding into a down coiler (the manner of the movement is hereinafter referred to as a conveying schedule) can be recognized completely.

Based on the conveying schedule, the minimum extraction pitch $\tau_M$* from the heating furnace permissible from the side of the mill line can be determined as follows.

Figure 1:
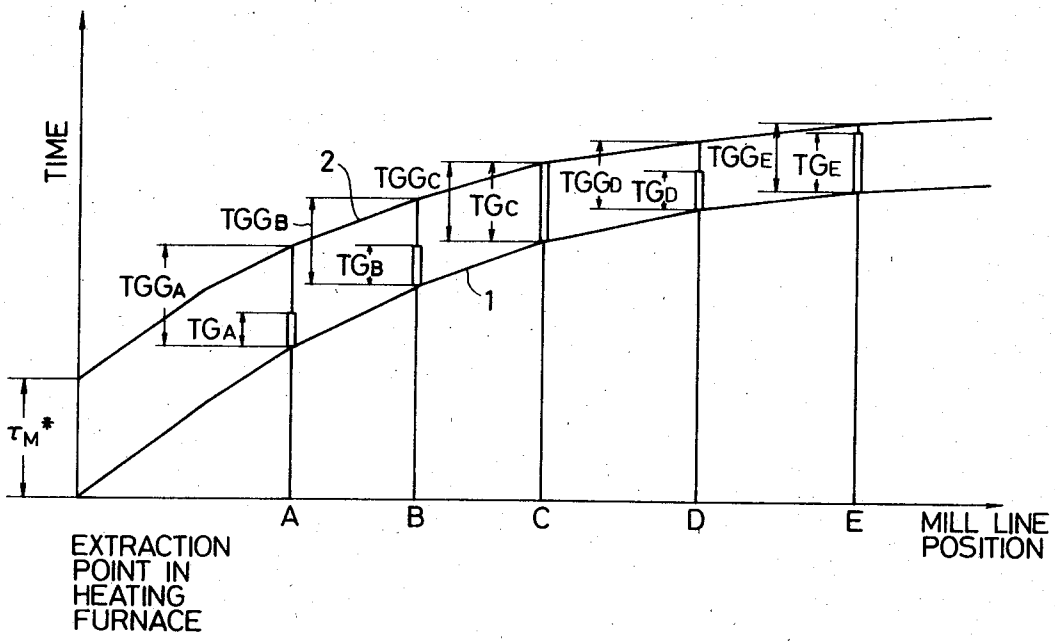
FIG. 1 is a graph showing the conveying schedules for the trailing end of a preceding slab and the leading end of a succeeding slab respectively.

As shown in FIG. 1, the conveying schedule of a trailing end of a slab extracted from the heating furnace, conveyed on the mill line, rolled and then taken up into the down coiler can be determined as shown by the curve 1.

The conveying schedule for a leading end of a subsequent slab can also be determined quite in the same manner as shown by the curve 2 if the rolling schedule therefor is determined.

In each of the facilities on the mill line, it is impossible to arbitrarily decrease a gap time between the trailing end of the preceding slab and the leading end of the subsequent slab, i.e., a time interval $TGG_A$ from the passage of the trailing end of the preceding slab at a particular point A up to a passage of the leading end of the subsequent slab at that point on the mill line in FIG. 1. There is a certain limit in the gap time and the limit is referred to as a gap time restrictive condition $TG_A$. For instance, if the trailing end of the preceding slab and the leading edge of the succeeding slab are placed simultaneously on one identical conveyor table and aimed conveying speeds for the slabs are different, it makes stable conveyance impossible, so that it is necessary to require a gap time restrictive condition.

In this way, there are gap time restrictive conditions $TG_A - TG_E$ respectively for each of particular points A–E in each of the facilities and values thereof are different from each other.

Accordingly, for the minimum extraction pitch from the heating furnace that is acceptable in the side of the mill line, gap time $TGG_A$ . . . $TGG_E$ at each of the particular points is determined based on the conveying schedule for the trailing end of the preceding slab and the conveying schedule for the leading end of the succeeding slab and the minimum extraction pitch $\tau_M$* is determined so that the gap time is at least as great as the gap time restrictive conditions $TG_A$, $TG_B$, . . . $TG_E$.

Considering from the side of the heating furnace, the temperature $T_{IN}$ of the slab to be charged in the heating furnace is previously given and an aimed extraction temperature $T_{EXTL}$* is also given. However, it is impossible to arbitrarily shorten the extraction pitch even if it is desired to improve the rolling efficiency TPH, because of restrictions for the heating furnace facilities. That is, there are an upper limit $F_U$ELU in the flow rate of fuel to be supplied to the heating furnace and an upper limit $T_{WU}$ in the wall temperature in view of the protection of the wall of the heating furnace. Because of the restrictive conditions for the heating furnace, if the aimed rolling efficiency is set excessively high, the slabs cannot be heated to an aimed extraction temperature.

If the size of the slab to be charged is given as W, the shortest furnace residence time $t_F$* necessary for heating the slab to the aimed extraction temperature in the heating furnace is a function of $F_U$ELU, $T_{WU}$, W, $T_{IN}$ and $T_{EXTL}$* and can be represented as:

$$t_F^* = f(F_U ELU, T_{WU}, W, T_{IN}, T_{EXTL}^*) \quad (1)$$

Figure 2:
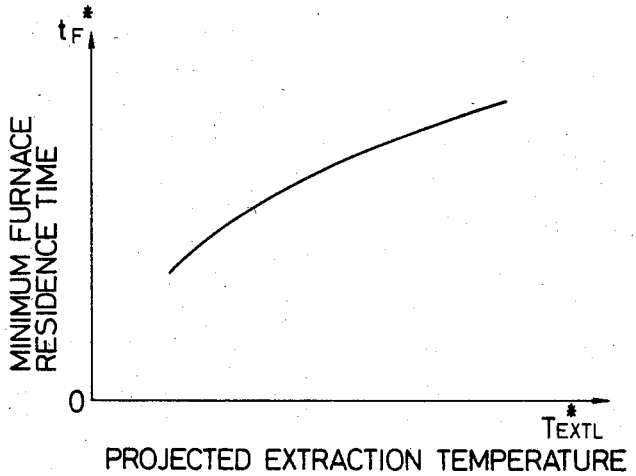
FIG. 2 is a graph showing the relationships between the aimed extraction temperature and the minimum furnace residence time.

FIG. 2 shows a relationship between the aimed extraction temperature $T_{EXTL}^*$ and the minimum furnace residence time $t_F^*$. Accordingly, the minimum extraction pitch $\tau_F^*$ . . . for the slab can be determined by an equation (2) which is as follows:

$$\tau_F^* = t_F^* - \sum_{i=1}^{m_F-1} \tau_{Fi} \quad (2)$$

where $\tau_{Fi}$: extraction pitch for the ith slab in the heating furnace, $m_F$: number of slabs already charged in the heating furnace.

Thus, it can be seen that in the continuous hot rolling process, there are the minimum extraction pitch $\tau_F^*$ restricted from the side of the heating furnace and the minimum extraction pitch $\tau_M^*$ restricted from the side of the mill line. Accordingly, the minimum extraction pitch $\tau^*$ for maintaining the rolling efficiency at an overall maximum is determined as:

$$\tau^* = Max\ \{\tau_M^*, \tau_F^*\} \quad (3)$$

Figure 3:
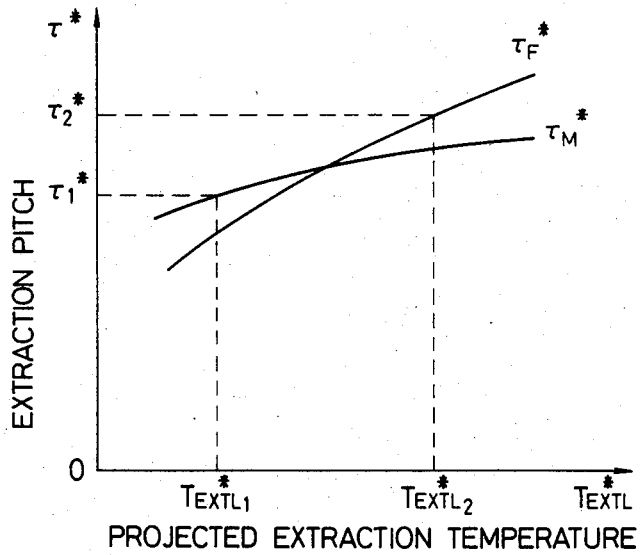
FIG. 3 is a graph showing the relationships between the extraction pitches restricted from the sides of the heating furnace and the mill line respectively and the aimed extraction temperature.

In the equation (3), Max {. , .} means to select the greater of the values in { }. The relationship between $\tau_F^*$ and $\tau_M^*$ is shown in FIG. 3.

Figure 4:
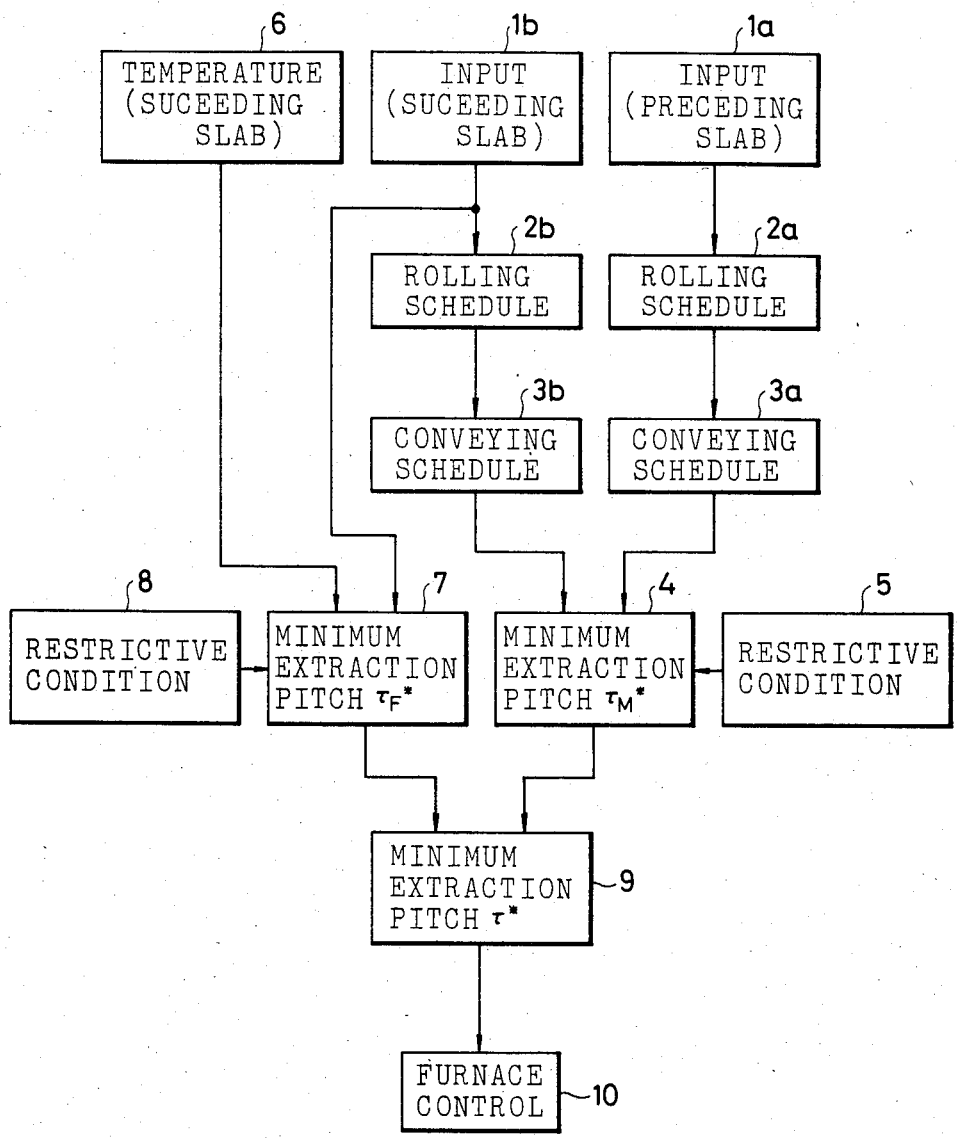
FIG. 4 is a block diagram showing the steps for the method of controlling the rolling efficiency according to this invention.

The concept of this invention has thus been described specifically, and FIG. 4 shows the operation thereof in a block diagram.

In FIG. 4, an aimed extraction temperature $T_{EXTL}^*$ for the preceding slab, a desired temperature FDT at the finishing mill exit and information for the slab and the product are inputted (block 1*a*) and the rolling schedule for the slab on the mill line is calculated based on the above inputs in a block 2*a*. Then, a conveying schedule for the trailing end of the slab is determined in a block 3*a*, using the rolling schedule obtained in the block 2*a*.

With respect to the succeeding slab, the conveying schedule for the leading end of the slab can be determined quite in the same manner in blocks 1*b*–3*b*.

In a block 4, minimum extraction pitch $\tau_M^*$ from the heating furnace acceptable in the side of the mill line is calculated based on the conveying schedules for the trailing end of the preceding slab and the leading end of the succeeding slab and the gap time restrictive conditions TGi at a particular point for each of the facilities on the mill line from a block 5.

The heating furnace charging temperature $T_{IN}$ for the succeeding slabs is inputted in a block 6 and the minimum extraction pitch $\tau_F^*$ from the heating furnace permissible from the side of the heating furnace is calculated (a block 7) based on the input from the block 1*b*, the restrictive conditions for the heating furnace, that is, the maximum flow rate of fuel $F_U$ELU chargeable to the heating furnace and the maximum wall temperature $T_{WU}$ allowable to the heating furnace inputted (a block 8).

Finally, the minimum extraction pitch $\tau^*$ from the heating furnace that makes the entire rolling efficiency maximum is determined in a block 9 using the minimum extraction pitches $\tau_M^*$, $\tau_F^*$ from the heating furnace calculated in view of the mill line and the heating furnace.

The extraction pitch $\tau^*$ from the heating furnace determined in the block 9 is inputted to a heating furnace control device 10.

The rolling efficiency can be improved by lowering the aimed extraction temperature of the slabs from the heating furnace. However, if the temperature is lowered excessively, desired temperature at the exit of the mill can no more be maintained in view of the capacity of the mill line and of the possibility that the required rolling torque may exceed the performance of the mill. It will be apparent that the aimed extraction temperature should be determined while taking the above situations into situation.

Figure 5:
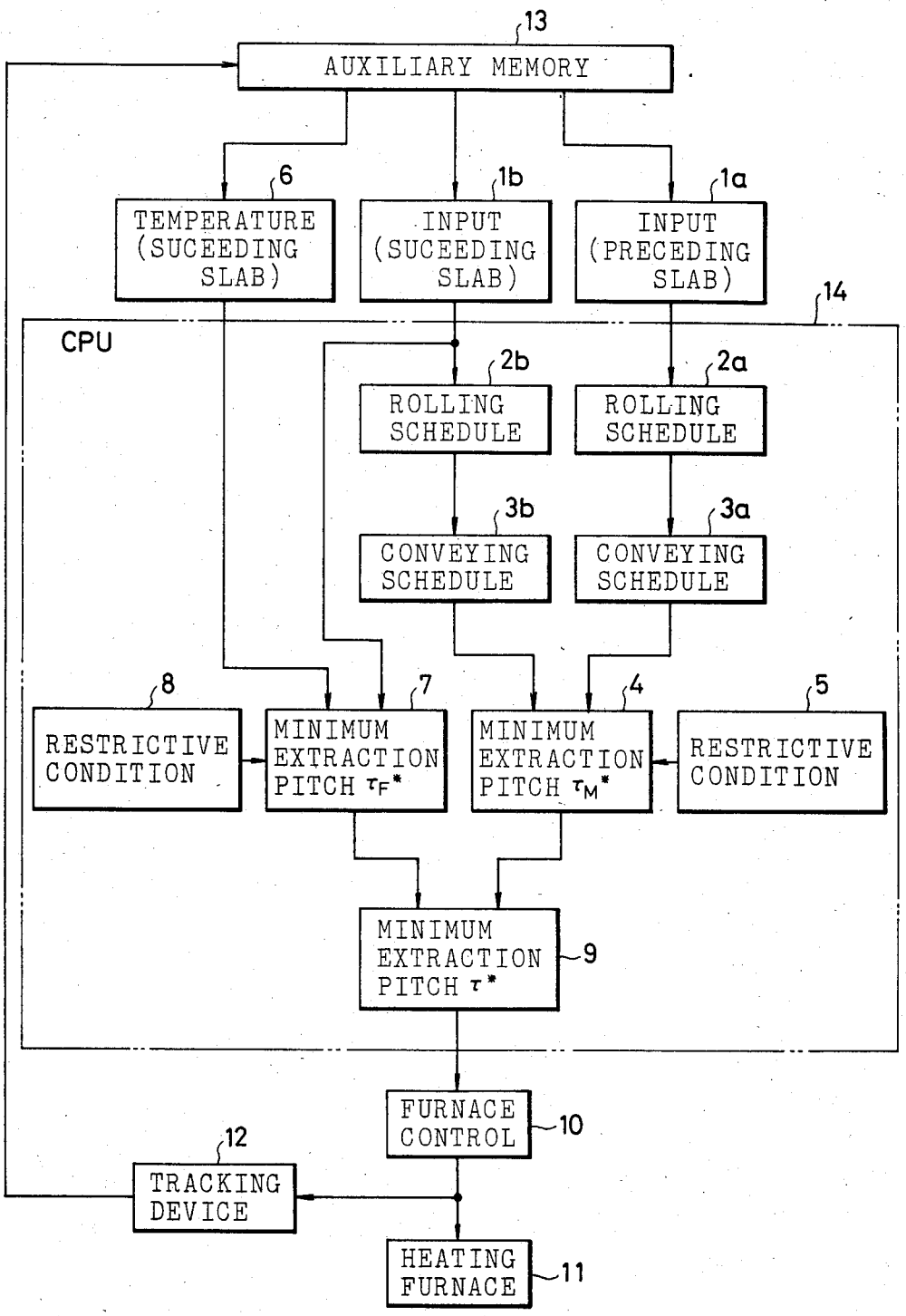
FIG. 5 is a schematic view for the structure of an apparatus employed in carrying out this invention.

FIG. 5 shows an apparatus for performing the steps of the blocks in FIG. 4.

individual slabs charged into the heating furnace 11 and given namings in the step they are prepared and are detected respectively when they reach the tracking device 12.

An auxiliary memory 13 previously stores various information such as thickness, length, width, and kind of steel for individual slabs that are detected, as well as thickness and width of the aimed products. The stored information is read out as the succeeding slab input and the preceding slab input (1*b* and 1*a*), and the central control unit 14 executes calculations in the blocks 2*a*–9.

The heating furnace control device 10 controls the fuel amount and the extracting speed for the heating furnace based on the minimum extraction pitch $\tau^*$ determined by the CPU 14.

As described above, according to this invention, operation in the continuous hot rolling process can be performed at the maximum rolling efficiency by considering the entire set of restrictive conditions for each of the facilities from the heating furnace up to the down coiler.

What is claimed is:

1. A method of continuous hot rolling which comprises the steps of arranging slabs on a mill line for passage through a heating furnace, passing the slabs into the heating furnace, heating the slabs in the heating furnace, extracting the slabs from the heating furnace, and passing the slabs through a finish mill, wherein the method further comprises the steps of determining a rolling schedule and a conveying schedule on the mill line for the slabs arranged in succession based on an aimed extraction temperature of the slabs from the heating furnace and a predetermined temperature at an exit of the finish mill, calculating a first minimum extraction pitch for the slabs from the heating furnace under restrictions imposed on a mill line side, calculating a second minimum extraction pitch for slabs from the heating furnace under restrictions imposed on a heating furnace side based on slab temperature charged to the heating furnace and the aimed extraction temperature, determining an optimum extraction pitch for the slabs from the heating furnace to maximize the overall rolling efficiency by comparing both of said minimum extraction pitches, and controlling said hot rolling method in accordance with the optimum extraction pitch determination step.

* * * * *